United States Patent [19]

Kobayashi

[11] 4,314,111

[45] Feb. 2, 1982

[54] COMBINED DOUBLE SWITCH UNIT

[75] Inventor: Mitsuo Kobayashi, Gifu, Japan

[73] Assignee: Kabushiki Kaisha Tokai Rika Denki Seisakusho, Aichi, Japan

[21] Appl. No.: 155,111

[22] Filed: May 30, 1980

[30] Foreign Application Priority Data

Jun. 1, 1979 [JP] Japan ..... 54-74848[U]

[51] Int. Cl.[3] ..... H01H 9/00

[52] U.S. Cl. ..... 200/4; 15/250.01; 15/250.02; 200/330; 200/339; 200/340

[58] Field of Search ..... 200/4, 339, 329, 340; 15/250.01, 250.02

[56] References Cited

U.S. PATENT DOCUMENTS 2,511,618 6/1950 Baur ..... 200/4

3,227,817 1/1966 Ogren ..... 15/250.02 X

*Primary Examiner*—Gene Z. Rubinson

*Assistant Examiner*—Morris Ginsburg

*Attorney, Agent, or Firm*—Wenderoth, Lind & Ponack

[57] ABSTRACT

An improved switch unit for use, for example, in a motor vehicle in which a first and a second switch mechanisms are integrally incorporated together with a first and a second operating members for operating the switch mechanisms so as to reduce the space to be occupied by the switch unit on the whole, while the first operating member is arranged to be rotatable in association with the depression of the second operating member for elimination of troublesome operating procedures, with simultaneous simplification of the entire construction.

8 Claims, 7 Drawing Figures

COMBINED DOUBLE SWITCH UNIT

BACKGROUND OF THE INVENTION

The present invention generally relates to a switching arrangement, and more particularly, to a switch unit including a first switch mechanism and a second switch mechanism which are respectively controlled for opening and closing by corresponding two kinds of operating members.

Generally, in motor vehicles for example, when a windshield washer solution is discharged, with driving of windshield wipers interrupted, it is preferable that the windshield wipers are immediately started to be driven for efficient wiping. However, if a switch for discharing the windshield washer solution is provided separately from a switch for driving the windshield wipers as in the conventional arrangements, it becomes necessary to operate the windshield wiper driving switch after having manipulated the windshield washer solution discharging switch, and thus, the operations of the switches are complicated, and moreover, spaces occupied by these switches become considerably large. For overcoming the disadvantages as described above, there has conventionally been proposed an arrangement in which the windshield wiper driving switch is associated in its function with the windshield washer solution discharging switch. The known arrangement as described above, however, still has such drawbacks that not only the mechanism required for the associated function complicates the construction of the switch unit, with a consequent high cost, but the spaces occupied by the respective switches are undesirably increased.

SUMMARY OF THE INVENTION

Accordingly, an essential object of the present invention is to provide an improved switch unit in which first and second switch mechanisms are integrally incorporated together with first and second operating members for operating the switch mechanisms so as to reduce the space to be occupied by the switch unit on the whole, while the first operating member is arranged to be rotatable in association with the depression of the second operating member for elimination of troublesome operating procedures, with simultaneous simplification of the entire construction.

Another important object of the present invention is to provide an improved switch unit of the above described type which is stable and accurate in functioning, with a high reliability, and can be manufactured on a large scale at low cost.

In accomplishing these and other objects, according to one preferred embodiment of the present invention, there is provided a switch unit which includes a support frame, a first operating member pivotally supported by the support frame through a shaft member for rotational movement thereabove, a second operating member movably supported in the first operating member so as to extend therethrough for reciprocation in a linear direction within the first operating member, a first switch mechanism arranged to be selectively opened and closed following the rotational movement of the first operating member, a second switch mechanism arranged to be closed upon depression of the second operating member, and a cam portion with which part of the second operating member is brought into contact for sliding movement thereover upon depression of the second operating member in a state where the first operating member is located at one position of the rotational movement, and which imparts rotational force to the first operating member through the second operating member by the contact of the part of the second operating member with the cam member for sliding movement thereover, so as to rotate the first operating member to the other position of the rotational movement.

By the arrangement of the present invention as described above, not only the space occupied by the switch unit is appreciably reduced, but operation of the switch unit is advantageously facilitated through simple construction, with substantial elimination of disadvantages inherent in the conventional switch units of this kind.

BRIEF DESCRIPTION OF THE DRAWINGS

These and other objects and features of the present invention will become apparent from the following description of a preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
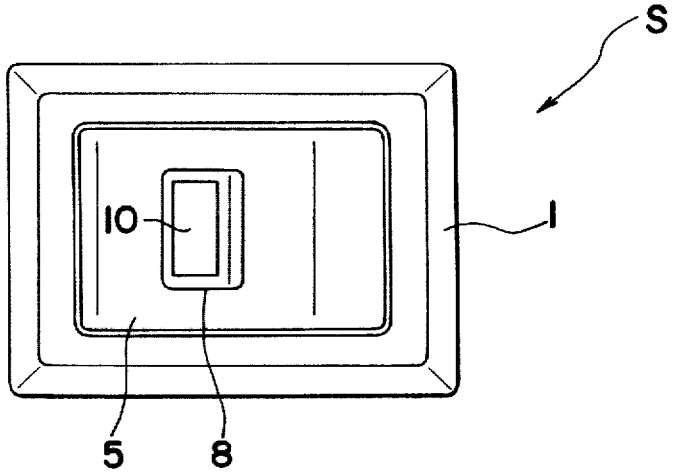
FIG. 1 is a top plan view of a switch unit according to one preferred embodiment of the present invention.

Referring now to the drawings, there is shown in FIGS. 1 through 6 a switch unit S according to one preferred embodiment of the present invention as applied to a rear windshield wiper switch of a motor vehicle (not shown). The switch unit S generally includes a housing or support frame 1 having a rectangular cross section and open at upper and lower faces as shown in FIGS. 2 to 5, and a first operating knob or operating member 5 and a second operating knob or operating member 8 operably housed in the support frame 1 for respectively actuating a first switch mechanism 13 and a second switch mechanism 14 also provided in support frame 1 in a manner as described in detail hereinbelow.

Figure 2:
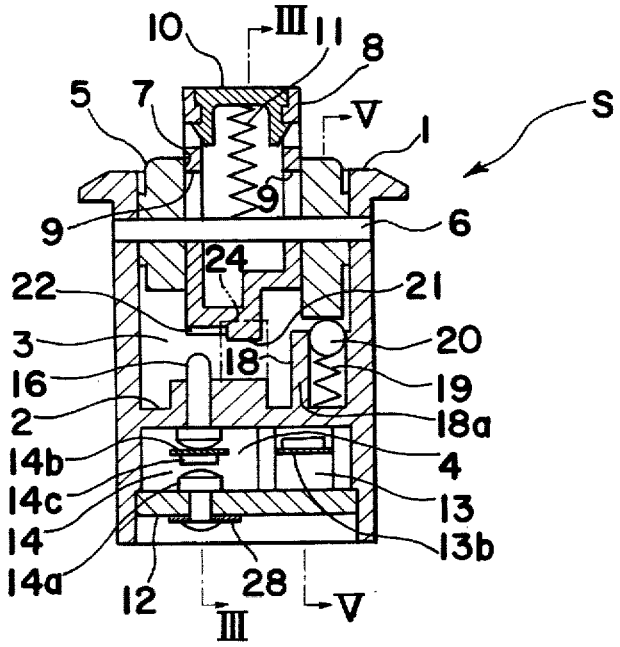
FIG. 2 is a side sectional view of the switch unit of FIG. 1.
Figure 3:
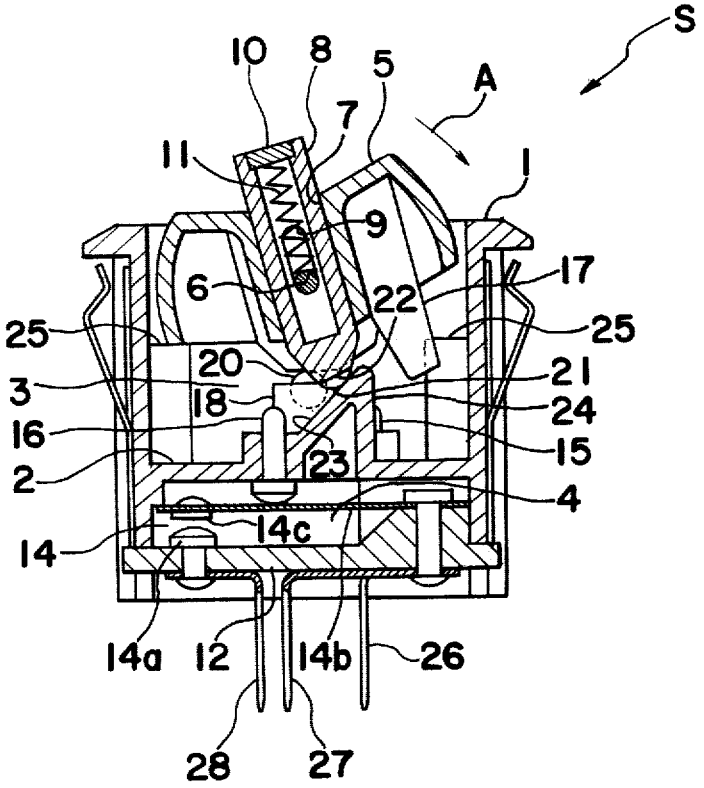
FIG. 3 is a sectional view taken along the line III—III in FIG. 2.
Figure 4:
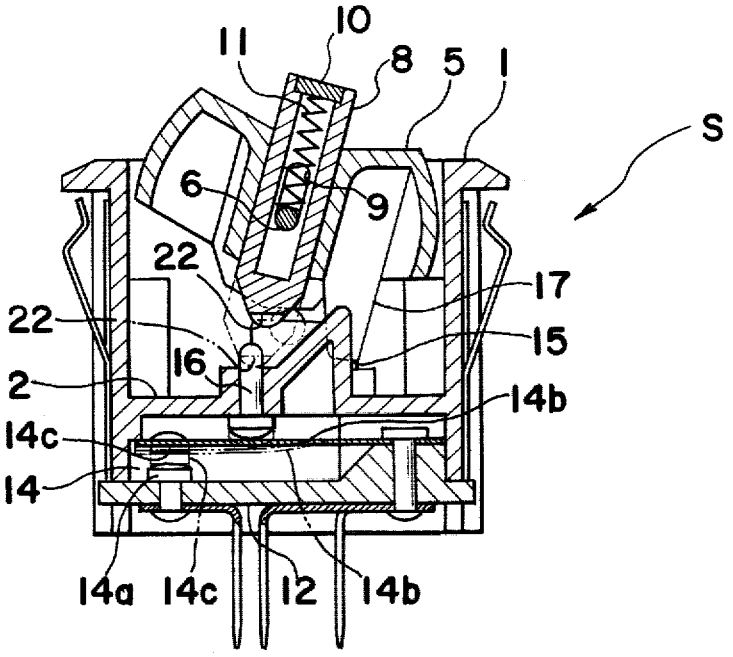
FIG. 4 is a view similar to FIG. 3, which particularly shows operating members thereof in a different position.
Figure 5:
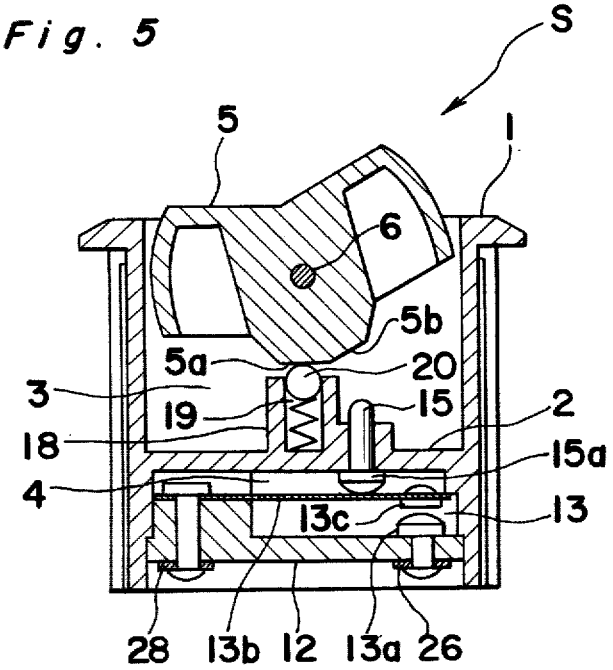
FIG. 5 is a sectional view taken along the line V—V in FIG. 2.
Figure 6:
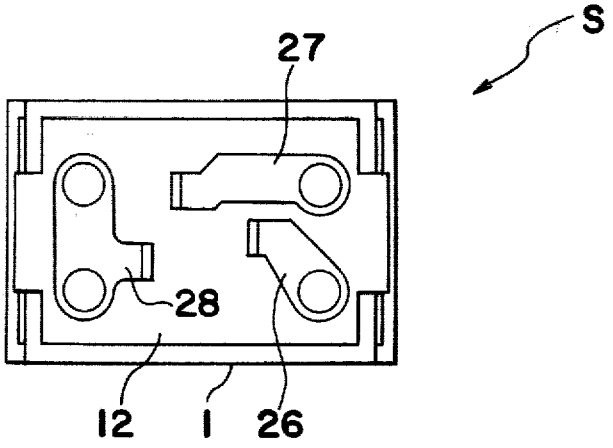
FIG. 6 is a bottom plan view of the switch unit of FIG. 1.

The support frame 1 has its interior divided into an upper chamber 3 and a lower chamber 4 by a laterally extending partition wall 2 integrally formed with inner walls of the support frame 1 as shown in FIGS. 2 to 4, while the first operating knob or operating member 5 is movably accommodated at the upper portion of the chamber 3 so as to close the upper opening of the frame 1 and pivotally supported by the corresponding inner walls of support frame 1 through a shaft 6 for rotation from one position to the other position. The first operating knob 5 has a rectangular bore 7 vertically extending therethrough at its central portion, in which bore 7, the tubular second operating knob or operating member 8 of a rectangular cross section is movably accommodated for reciprocation in a linear or vertical direction with respect to first operating knob 5. The shaft 6 for the first operating knob 5 extends through elongated openings 9 vertically formed in opposite side walls of the second operating knob 8, and thus, knob 8 is restricted in its vertical movement by the shaft 6. Meanwhile, between a name plate 10 fitted in an upper opening of the second operating knob 8 and the shaft 6, a compression spring 11 is disposed for normally urging knob 8 upwardly in FIG. 2. On the other hand, at the lower portion of the lower chamber 4 of the support frame 1, there is fixed a switch base 12 in a position below and spaced from the partition wall 2 so as to close the lower opening of frame 1, and on this switch base 12, the first switch mechanism 13 and second switch mechanism 14 are respectively provided in a manner as described hereinbelow. More specifically, the first switch mechanism 13 includes a stationary contact 13*a* suitably secured to one side of the switch base 12, and a movable contact 13*c* fixed to one corresponding end of a movable piece 13*b* which is suitably supported in a cantilever fashion at its other end, by the other side of the base 12, so that the movable piece 13*b* may be depressed downwards in FIG. 5 by a presser pin 15 provided in a position above the movable piece 13*b* so as to extend through the partition wall 2 for vertical sliding movement and to be restricted for the upward movement thereof by a retaining portion 15*a*. Similarly, the second switch mechanism 14 disposed side by side adjacent to the first switch mechanism 13 includes a stationary contact 14*a* also suitably fixed to the switch base 12, and a movable contact 14*c* provided at one corresponding end of a movable piece 14*b* which is suitably supported in a cantilever fashion at the other end thereof, by the switch base 12, while movable piece 14*b* is arranged to be depressed downwards by a presser pin 16 provided in the partition wall 2 in a manner similar to that of the presser pin 15 for the first switch mechanism 13. It is to be noted here that the presser pins 15 and 16 are normally urged upwards respectively by the spring force of the movable pieces 13*b* and 14*b*. The knob 5 has a projection 17 extending downwardly from the under surface thereof for depressing the presser pin 15, and arranged to release the presser pin 15 from the depression when knob 5 is in one position of rotation (referred to as an OFF position hereinbelow) as shown in FIG. 3, and to depress presser pin 15 when the knob 5 is rotated to the other position (referred to as an ON position hereinbelow) as shown in FIG. 4 for bringing the movable contact 13*c* into contact with the stationary contact 13*a*. Therefore, the first switch mechanism 13 is adapted to be opened or closed according to the rotation of the first operating knob 5 between the OFF and ON positions mentioned above. On the other hand, the partition wall 2 of the support frame 1 is further provided with a hollow boss portion 18 defined by wall 18*a* extending upwardly to a predetermined extent from the partition wall 2 and a corresponding wall of the support frame 1. In the boss portion 18, there is disposed a detent ball 20 which is normally urged upwardly by a compression spring 19 also accommodated in the boss portion 18, with detent ball 20 being arranged to contact inclined surfaces 5*a* and 5*b* formed in the lower edge of one corresponding side wall of the first operating knob 5 so as to constitute a detent mechanism therebetween (FIGS. 2 and 5). More specifically, as is seen from FIG. 5, when the first operating knob 5 is in the OFF position of FIG. 3, the detent ball 20 is caused to contact the inclined surface 5*a* under pressure, while when said knob 5 is in the ON position of FIG. 4, the detent ball 20 is brought into pressure contact with the inclined surface 5*b* of the first operating knob 5 for retaining the knob 5 respectively at the OFF and ON positions, with a feeling of stepwise operation being simultaneously obtained during operation of first operating knob 5. Furthermore, the lower end of the second operating knob 8 is gradually narrowed downwards to provide a sliding projection 21 suitably rounded at its lowermost edge and an inclined face 22 for depression formed stepwise adjacent to sliding projection 21 (FIGS. 2 to 4), while on the partition wall 2 in a position corresponding to projection 21, a protrusion 24 having an inclined cam surface 23 is formed so as to extend upwardly from partition wall 2 (FIG. 3). The sliding projection 21 of the second operating knob 8 is thus positioned to slide over the cam surface 23 of the protrusion 24 when the first operating knob 5 is in the OFF position in FIG. 3. Meanwhile, the inclined face 22 of the second operating knob 8 is so positioned as to confront the presser pin 16 from above when the first operating knob 5 is in the ON position of FIG. 4, and therefore, upon depression of the second operating knob 8 in the above state, the presser pin 16 is depressed by the inclined face 22 of knob 8 as shown by chain lines in FIG. 4 to bring the movable contact 14*c* into contact with the stationary contact 14*a*, and thus, the second switch mechanism 14 is closed. On the contrary, when the second operating knob 8 is depressed under the state where the first operating knob 5 is in the OFF position of FIG. 3, the sliding projection 21 of the knob 8 slides over the inclined cam surface 23 of the protrusion 24 downwardly, whereby rotational force in the direction of the arrow A in FIG. 3 is exerted on the second operating knob 8, and consequently, the presser pin 16 is depressed by the inclined face 22 of the second operating knob 8 to close the second switch mechanism 14. Simultaneously, the rotational force in the direction of the arrow A is imparted to the first operating knob 5 to rotate knob 5 towards the ON position of FIG. 4, and thus, the first switch mechanism 13 is closed.

The switch unit S is further provided with a pair of ribs 25 (FIG. 3) formed in the corresponding inner walls of the support frame 1 so as to function as stopper means for restricting the rotation of the first operating knob 5, a terminal plate 26 connected to the stationary contact 13*a*, another terminal plate 27 connected to the movable contact 14*c*, and still another terminal plate 28 commonly connected to the stationary contact 14*a* and movable contact 13*c*, terminal plates 26, 27 and 28 extending downwardly from the switch base 12 for connection with external circuits as described hereinbelow.

Figure 7:
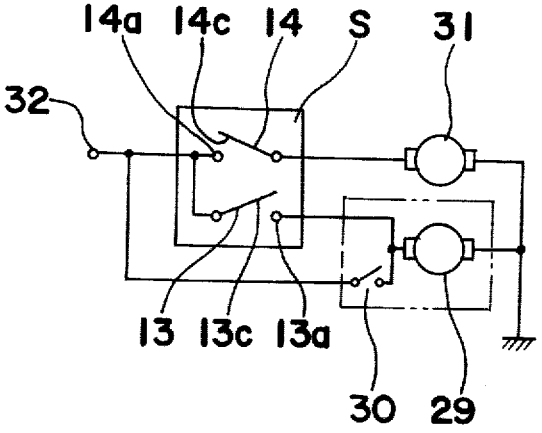
FIG. 7 is an electrical circuit diagram showing external connections of the switch unit of FIG. 1.

Referring to FIG. 7 showing electrical connections of the switch unit S according to the present invention with external circuits, the first and second switch mechanism 13 and 14 of the switch unit S are connected between a power source terminal 32 and the ground respectively through a windshield wiper motor 29 for the rear windshield wiper and a pump motor 31 for the washer pump, with one end of the wiper motor 29 being further connected to the power source terminal 32 through a known cam switch 30 for stopping such motor at a predetermined point.

By the above arrangement, when the first operating knob 5 is rotated to the ON position, the first switch mechanism 13 is closed to energize the wiper motor 29, and thus, the rear windshield wiper is driven. Under the above state, upon depression of the second operating knob 8, the second switch mechanism 14 is closed to energize the pump motor 31, whereby the windshield washer solution is discharged. Meanwhile, when the second operating knob 8 is depressed in the state where the first operating knob 5 is in the OFF position, i.e. in the state where the rear windshield wiper is stopped, the second switch mechanism 14 is closed to discharge the windshield washer solution, and in association with the above, the first operating knob 5 is rotated towards the ON position to drive the rear windshield wiper.

According to the arrangement of the present invention as described so far, since the second operating knob 8 is provided to extend through the first operating knob 5, the switch unit can be made extremely compact in size, without any possibility of increasing the space to be occupied by the switch unit on the whole. Moreover, the arrangement in which the first operating knob 5 is rotated to the ON position in association with the operation of the second operating knob 8 advantageously eliminates troublesome operating procedures of the switch unit. Furthermore, since the protrusion 24 having the inclined cam surface 23, etc. has only to be provided for the associated movement of the first operating knob 5 as described above, the construction of the switch unit may be simplified to a large extent.

As is clear from the foregoing description, according to the arrangement of the present invention, the space to be occupied by the switch unit on the whole can be appreciably decreased by integrally incorporating therein the first and second switch mechanisms together with the first and second operating members for operating the respective switch mechanisms, while troublesome procedures in operation may be removed, since the first operating member can be rotated in association with the depression of the second operating member, without any complication of the construction of the entire switch unit.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A switch unit comprising:

a support frame including a partition wall separating the interior of said frame into first and second chambers;

a first operating member mounted within said first chamber about a shaft member for pivotal movement between first and second positions, said first operating member having extending therefrom into said first chamber a first switch operating portion;

a second operating member mounted within said first operating member for movement therein in opposite linear directions between a first outer position and a second inner position, said second operating member being pivotal with said first operating member during movement thereof between said first and second positions thereof, said second operating member having at an inner end thereof a second switch operating portion and a sliding portion;

spring means for urging said second operating member to said first outer position thereof;

first and second switch mechanisms positioned within said second chamber;

first pin means, mounted for movement through said partition wall, and positioned to be depressed by said first switch operating portion upon movement of said first operating member from said first position thereof to said second position thereof for thereby actuating said first switch mechanism;

second pin means, mounted for movement through said partition wall, and positioned to be depressed by said second switch operating portion upon linear movement of said second operating member from said first outer portion thereof to said second inner position thereof, when said first operating member is in said second position thereof, for thereby actuating said second switching mechanism; and cam surface means, provided on said partition wall and extending along the path of movement of said sliding portion during pivotal movement of said first operating member, and thereby of said second operating member, between said first and second positions thereof, for, upon linear movement of said second operating member from said first outer position thereof to said second inner position thereof when said first operating member is in said first position thereof, being slidably contacted by said sliding portion and thereby imparting pivoting movement to said second operating member and thus causing said first operating member to pivot to said second position thereof, thereby causing simultaneous depression of said first and second pin means and actuation of said first and second switch mechanisms.

2. A switch unit as claimed in claim 1, further comprising detent means for retaining said first operating member in said first and second positions thereof.

3. A switch unit as claimed in claim 2, wherein said detent means comprises first and second inclined surfaces on said first operating member, and a detent member urged toward said first and second inclined surfaces when said first operating member is in said first and second positions thereof, respectively.

4. A switch unit as claimed in claim 3, wherein said detent member comprises a detent ball disposed in a boss portion of said partition wall.

5. A switch unit as claimed in claim 1, wherein each said switch mechanism comprises a fixed contact and a movable contact positioned to be moved by the respective said pin means into contact with said fixed contact.

6. A switch unit as claimed in claim 1, further comprising ribs within said first chamber at positions to limit pivotal movement of said first operating member and to define said first and second positions thereof.

7. A switch unit as claimed in claim 1, wherein said first switch mechanism is arranged for, when actuated, operating a wiper motor for driving a rear windshield wiper.

8. A switch unit as claimed in claims 1 or 7, wherein said second switch mechanism is arranged for, when actuated, operating a pump motor for discharging a windshield washer solution.

* * * * *